US006060631A

United States Patent [19]

James, Jr. et al.

[11] Patent Number: 6,060,631

[45] **Date of Patent: *May 9, 2000**

[54] PROCESS FOR THE CONVERSION OF PLASTIC TO PRODUCE A SYNTHETIC CRUDE OIL

[75] Inventors: Robert B. James, Jr., Northbrook; Tom N. Kalnes, La Grange, both of Ill.

[73] Assignee: UOP LLC, Des Plaines, Ill.

[ * ] Notice: This patent is subject to a terminal disclaimer.

[21] Appl. No.: 09/086,114

[22] Filed: May 28, 1998

Related U.S. Application Data

[60] Provisional application No. 60/050,521, Jun. 23, 1997.

[51] Int. Cl.[7] ..... C10G 1/00

[52] U.S. Cl. ..... 585/241; 201/2.5; 201/25; 208/49; 208/400; 208/415

[58] Field of Search ..... 585/241; 201/2.5, 201/25; 208/49, 400, 415

[56] References Cited

U.S. PATENT DOCUMENTS 4,818,368 4/1989 Kalnes et al. ..... 208/50
5,969,201 10/1999 Kalnes et al. ..... 585/241

*Primary Examiner*—Walter D. Griffin
*Assistant Examiner*—Nadine Preisch
*Attorney, Agent, or Firm*—John G. Tolomei; John F. Spears, Jr.; John G. Cutts, Jr.

[57] ABSTRACT

A process for the conversion of plastic to produce a synthetic crude oil by means of separating a liquefied plastic into a lower boiling fraction and a higher boiling fraction containing non-distillable particulate matter which is admixed with a hydrocarbonaceous recycle stream and filtered. The filtered stream having a reduced concentration of finely divided particulate matter and the distillable lower boiling stream together with hydrogen is contacted with a hydro-demetallization catalyst in a hydro-demetallization zone. The effluent from the hydro-demetallization zone is contacted with a hydrocracking catalyst in a hydrocracking zone to produce lower boiling hydrocarbons suitable for use as a synthetic crude oil and to produce gaseous, water-soluble inorganic compounds. A recovered hydrogen-rich gaseous stream is preferably recycled to the hydro-demetallization zone. The gaseous, water-soluble inorganic compounds are removed by scrubbing the hydrocracking zone effluent with an aqueous stream. A portion of the hydrocarbons recovered from the hydrocracking zone effluent is recycled to aid in filtration.

14 Claims, 1 Drawing Sheet

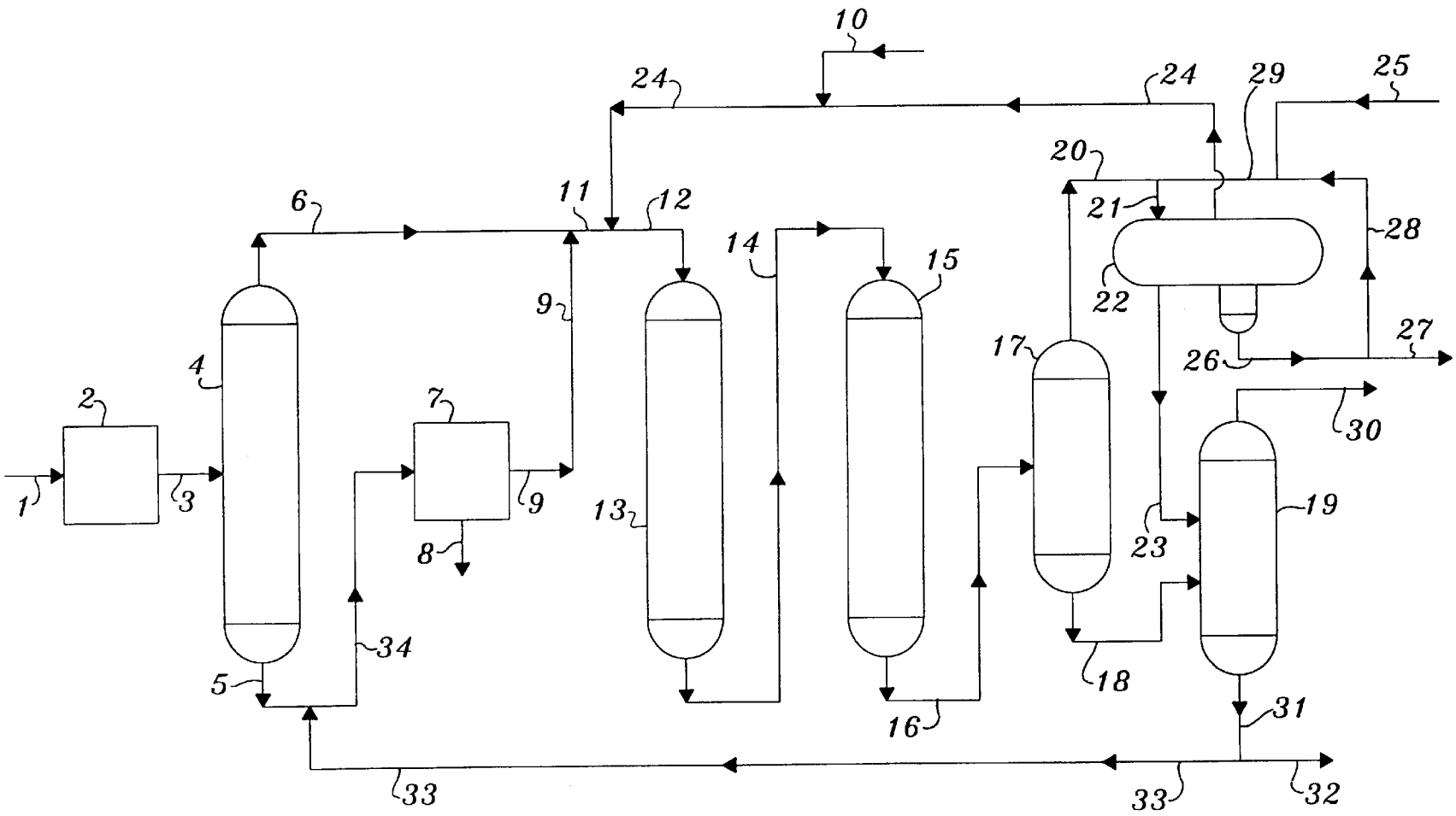
1
2
3
4
5
6
7
8
9
9
10
11
12
13
14
15
16
17
18
19
20
21
22
23
24
24
25
26
27
28
29
30
31
32
33
33
34

PROCESS FOR THE CONVERSION OF PLASTIC TO PRODUCE A SYNTHETIC CRUDE OIL

CROSS-REFERENCE TO RELATED APPLICATION

This application claims the benefit of provisional application No. 60/050,521 filed on Jun. 23, 1997, and is hereby incorporated by reference.

FIELD OF THE INVENTION

The field of art to which this invention pertains is the recovery and conversion of plastic including post-consumer waste plastic to produce a synthetic crude oil containing hydrocarbonaceous compounds.

BACKGROUND OF THE INVENTION

There is a steadily increasing demand for technology which is capable of the conversion and recovery of useful products from discarded and unwanted materials such as post-consumer waste plastic. With the increased environmental emphasis for the conversion and recycle of unwanted and potentially environmentally damaging organic waste streams, there is an increased need for improved processes to convert organic waste streams to produce synthetic crude oils which may then subsequently be used to produce valuable, finished products such as petrochemical feedstocks, specialty oils and liquid transportation fuels. Desirable fuels include gasoline, diesel fuel and liquefied petroleum gas (LPG). Petrochemical feedstocks include feed to an ethylene plant and specialty oils include lubricating oil blendstocks. For example, during the disposal or recycle of non-biodegradable organic waste streams, an important step in the total solution to the problem is to produce an organic stream or hydrocarbon which facilitates the ultimate resolution to produce product streams which may subsequently be handled in an environmentally acceptable manner. Therefore, those skilled in the art have sought to find feasible and economical techniques to convert plastic including post-consumer waste plastic to produce synthetic crude oils containing hydrocarbonaceous compounds.

INFORMATION DISCLOSURE

In U.S. Pat. No. 4,818,368, a process is disclosed for treating a temperature-sensitive hydrocarbonaceous stream containing a non-distillable component to produce a hydro-demetallized distillable hydrocarbonaceous product while minimizing thermal degradation of the hydrocarbonaceous stream.

SUMMARY OF THE INVENTION

The present invention provides a process for the conversion of plastic including post-consumer waste plastic to produce a synthetic crude oil by means of separating a liquefied plastic into a lower boiling fraction and a higher boiling fraction containing non-distillable particulate matter which latter fraction is admixed with a hydrocarbonaceous recycle stream and filtered to remove the non-distillable particulate matter. The resulting filtered higher boiling fraction and the lower boiling fraction is then hydro-demetallized in a hydro-demetallization reaction zone and subsequently introduced into a hydrocracking zone to produce lower boiling organic compounds and to remove heterogeneous components such as oxygen and halide, for example. The resulting effluent is cooled and partially condensed to produce a gaseous stream containing hydrogen and gaseous water-soluble inorganic compounds and a liquid stream containing hydrocarbon compounds. The gaseous stream is scrubbed to remove the gaseous water-soluble organic compounds and to thereby preferably produce a hydrogen-rich gaseous recycle stream. Important elements of the present invention are the minimization of utility costs due to the integration of the heating, hydro-demetallization and hydrocracking steps and the ability to produce a useful and valuable synthetic crude oil from post-consumer waste plastic.

One embodiment of the invention may be characterized as a process for the conversion of plastic to produce a synthetic crude oil which process comprises: (a) separating a liquefied stream of plastic to produce a distillable lower boiling stream and a higher boiling stream containing finely divided particulate matter; (b) filtering the higher boiling stream containing finely divided particulate matter in admixture with a hydrocarbonaceous recycle stream to produce a filtered stream having a reduced concentration of finely divided particulate matter; (c) contacting at least a portion of the distillable lower boiling stream from step (a), at least a portion of the filtered stream having a reduced concentration of finely divided particulate matter from step (b), and hydrogen with a hydro-demetallization catalyst in a hydro-demetallization zone operated at hydro-demetallization conditions; (d) contacting the resulting hydrogenhydrocarbon-containing stream from step (c) with a hydrocracking catalyst in a hydrocracking zone operated at hydrocracking conditions to produce an effluent comprising lower boiling hydrocarbons and gaseous, water-soluble inorganic compounds; (e) condensing at least a portion of the resulting effluent from the hydrocracking zone to produce a gaseous stream comprising hydrogen and the gaseous, water-soluble inorganic compounds, and a liquid stream comprising hydrocarbons; (f) contacting the gaseous stream comprising hydrogen and the gaseous, water-soluble inorganic compounds with an aqueous solution to recover the gaseous, water-soluble inorganic compounds and to produce a hydrogen-rich gaseous stream; (g) recycling at least a portion of the liquid stream comprising hydrocarbons to provide the hydrocarbonaceous recycle stream in step (b); and (h) recovering at least a portion of the liquid stream comprising hydrocarbons.

Other embodiments of the present invention encompass further details such as hydro-demetallization and hydrocracking catalysts, aqueous scrubbing solutions and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for the conversion of plastic. The post-consumer waste plastic preferably contemplated as a feedstock for the process of the present invention is a liquid plastic derived from solid plastic. A preferred liquid plastic is thermally derived from solid plastic in a liquefier. The thermally derived and dissolved liquid product is high in hydrogen content but contains non-distillable hydrocarbons and inorganic particulate matter together with high concentrations of hetero compounds containing halogen and oxygen. The preferred feedstock of liquefied plastic may suitably be prepared by heating post-consumer waste plastic either with or without a suitable solvent at a temperature less than about 800° F. The liquid plastic also contains insoluble, solid material that prevents it from being directly charged to a fixed bed reactor. The presence of finely divided particulate matter in the post-consumer waste plastic feed to the process of the present invention greatly increases the difficulty in producing a synthetic crude oil which may be successfully utilized for other uses. Particulate matter in a feed stream tends to deposit within the catalyst reaction zones and to plug fixed catalyst beds thereby abbreviating the time on stream. Preferred plastic is selected from the group consisting of high density polyethylene, low density polyethylene, polystyrene, polyvinylchloride and PET.

In accordance with the process of the present invention, a thermally derived stream containing plastic is separated to produce a distillable lower boiling stream and a higher boiling stream containing finely divided particulate matter. The distillable lower boiling stream preferably has an end boiling point in the range from about 150 to about 850° F., and the higher boiling stream preferably has an end boiling point greater than about 850° F. The higher boiling stream containing finely divided particulate matter preferably contains more than about 50 weight percent non-distillable components. Any suitable means may be used to perform this separation, and fractionation or flashing is preferred.

The higher boiling stream containing finely divided particulate matter is admixed with an internally derived hydrocarbonaceous recycle stream and filtered to remove and reject the finely divided particulate matter in order to produce a filtered higher boiling stream having a reduced concentration of finely divided particulate matter. Any suitable means may be used to perform the filtration and a filter regenerated by backflushing is preferred.

In a preferred embodiment, the filtration is conducted with a sintered metal filter having pores preferably less than about 25 microns and more preferably less than about 10 microns. Since some of the contemplated feedstocks contain high molecular weight compounds, it is preferred that the filtration be conducted at a temperature sufficient to ensure that the plastic molecules are liquid and thereby recovered rather than be rejected with the inorganic particulate matter. Preferably, the filtration is conducted at a pressure sufficient to prevent vaporization of any of the plastic molecules. In addition, the filtration operating conditions are preferably selected to obtain a viscosity at operating temperatures of less than about 10 centistokes and more preferably less than about 5 centistokes.

The resulting filtered higher boiling stream having a reduced concentration of finely divided particulate matter, the distillable lower boiling stream, and a hydrogen-rich gaseous stream is introduced into a catalytic hydro-demetallization zone containing hydro-demetallization catalyst and maintained at hydro-demetallization conditions. The catalytic hydro-demetallization zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689 kPa gauge) to about 1800 psig (12411 kPa gauge). Suitably, the hydro-demetallization reaction is conducted with a maximum catalyst bed temperature in the range from about 400° F. to about 850° F. selected to perform the desired hydro-demetallization conversion to reduce or eliminate the undesirable characteristics or components of the feed stream. In accordance with the present invention, it is contemplated that the desired hydro-demetallization conversion includes, for example, dehalogenation, desulfurization, denitrification, olefin saturation and oxygenate conversion. Further preferred operating conditions include liquid hourly space velocities in the range from about 0.05 $hr^{-1}$ to about 20 $hr^{-1}$ and a hydrogen to feed ratio from about 200 standard cubic feet per barrel (SCFB) to about 50,000 SCFB, preferably from about 300 SCFB to about 20,000 SCFB.

The preferred catalytic composite disposed within the hereinabove-described hydro-demetallization zone can be characterized as containing a metallic component having hydro-demetallization activity, which component is combined with a suitable refractory inorganic oxide carrier material of either synthetic or natural origin. The precise composition and method of manufacturing the carrier material is not considered essential to the present invention. Preferred carrier materials are alumina, silica, and mixtures thereof. Suitable metallic components having hydro-demetallization activity are those selected from the group comprising the metals of Groups VIB and VIII of the Periodic Table, as set forth in the *Periodic Table of the Elements* E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VIB are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating reduced crude oil to remove nitrogen, metals and sulfur may function effectively in the hydro-demetallization zone of the present invention. It is further contemplated that hydro-demetallization catalytic composites may comprise one or more of the following components: cesium, francium, lithium, potassium, rubidium, sodium, copper, gold, silver, cadmium, mercury and zinc.

The hydrocarbonaceous effluent from the hydro-demetallization reaction zone is then introduced into the catalytic hydrocracking reaction zone in order to produce lower-boiling hydrocarbonaceous compounds. The catalytic hydrocracking reaction zone may contain a fixed, ebullated or fluidized catalyst bed and is preferably maintained under an imposed pressure from about atmospheric to about 2000 psig. Suitably, the hydrocracking reaction is conducted with a maximum catalyst bed temperature in the range from about 400° F. to about 850° F. selected to perform the desired hydrocracking conversion. Further preferred operating conditions include liquid hourly space velocities in the range from about 0.05 $hr^{-1}$ to about 20 $hr^{-1}$ and a hydrogen to feed ratio from about 200 SCFB to about 50,000 SCFB. The preferred hydrocracking catalyst disposed within the hydrocracking zone can generally be characterized as containing at least one metallic component having hydrogenation activity combined with a suitable refractory inorganic oxide carrier material of either synthetic or natural origin. The carrier material may contain amorphous and/or zeolitic components. The preparation of hydrocracking catalysts is well known to those skilled in the art.

The hydrocarbonaceous effluent from the hydrocracking reaction zone containing hydrocracked hydrocarbonaceous compounds and water-soluble inorganic compounds is cooled to produce a liquid stream comprising hydrocarbons and a gaseous stream comprising hydrogen, gaseous, water-soluble inorganic compounds and lower boiling hydrocarbonaceous compounds. The gaseous stream comprising hydrogen, gaseous, water-soluble inorganic compounds and lower boiling hydrocarbonaceous compounds is cooled and contacted with an aqueous scrubbing solution, and the resulting admixture is introduced into a separation zone in order to separate a spent aqueous stream, a liquid stream containing the hydrocarbonaceous compounds produced in the hydrocracking zone and a hydrogen-rich gaseous phase. The contact with the aqueous scrubbing solution may be performed in any convenient manner and is preferably conducted by cocurrent, in-line mixing which may be promoted by inherent turbulence, mixing orifices or any other suitable mixing means. The aqueous scrubbing solution is preferably introduced in an amount from about 1 to about 100 volume percent based on the effluent from the hydrocracking reaction zone. In accordance with the present invention, the aqueous scrubbing solution preferably contains a basic compound such as sodium carbonate, calcium hydroxide, ammonium hydroxide, potassium hydroxide or sodium hydroxide. In a preferred embodiment, the gaseous stream is contacted with an aqueous solution containing sodium carbonate solution which neutralizes and dissolves the water-soluble inorganic compounds. However, in general, the gaseous stream may be contacted with any suitable aqueous stream which accomplishes the objectives described herein. The recovered hydrogen-rich gaseous phase is recycled together with make-up hydrogen to provide at least a portion of the gaseous recycle stream.

The resulting liquid stream comprising hydrocarbons and the liquid stream containing the lower boiling hydrocarbonaceous compounds contain dissolved hydrogen and low molecular weight normally gaseous hydrocarbons and, in accordance with the present invention, it is preferred that these streams be stabilized in a convenient manner, such as, for example, by stripping or flashing to remove the normally gaseous components to provide a stable product.

At least a portion of the hydrocarbonaceous compounds recovered from the effluent from the hydrocracking zone is utilized as a hydrocarbonaceous recycle stream introduced and admixed into the higher boiling stream containing finely divided particulate matter before the filtration step to remove the particulate matter. The hydrocarbonaceous recycle stream acts at least in part to serve as a diluent and a solvent to improve and enhance the filtration and is preferably present in a ratio from about 1:1 to about 10:1.

DETAILED DESCRIPTION OF THE DRAWING

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a post-consumer waste plastic stream is introduced into plastic liquefier 2 via conduit 1. A liquefied post-consumer waste plastic is removed from plastic liquefier 2 via conduit 3 and introduced into separation zone 4. A distillable lower boiling stream is removed from separation zone 4 via conduit 6. A higher boiling stream containing finely divided particulate matter is removed from separation zone 4 via conduit 5 and is admixed with a hydrocarbonaceous recycle stream provided via conduit 33 and the resulting admixture is transported via conduit 34 and introduced into filtration zone 7. Finely divided particulate matter is removed from filtration zone 7 via conduit 8 and recovered. A filtered higher boiling stream having a reduced concentration of finely divided particulate matter is removed from filtration zone 7 via conduit 9 and is admixed with the previously-described distillable lower boiling stream provided via conduit 6 and the resulting admixture is transported via conduit 11 and is further admixed with a hydrogen-rich gaseous recycle stream provided via conduit 24. Fresh make-up hydrogen is introduced via conduit 10. This resulting admixture is transported via conduit 12 and introduced into hydro-demetallization zone 13. A resulting hydro-demetallized effluent containing hydrocarbons and gaseous water-soluble inorganic compounds is removed from hydro-demetallization zone 13 via conduit 14 and introduced into hydrocracking zone 15. A resulting hydrocracked product containing lower boiling hydrocarbons and gaseous water-soluble inorganic compounds is removed from hydrocracking zone 15 via conduit 16 and introduced into vapor-liquid separator 17. A gaseous stream containing hydrogen and water-soluble inorganic compounds is removed from vapor-liquid separator 17 via conduit 20 and is admixed with an aqueous scrubbing solution which is provided via conduit 29 and the resulting admixture is introduced via conduit 21 into vapor-liquid separator 22. A hydrogen-rich gaseous stream is removed from vapor-liquid separator 22 via conduit 24 and recycled as described hereinabove. An aqueous solution containing water-soluble inorganic compounds is removed from vapor-liquid separator 22 via conduit 26 and at least a portion thereof is removed from the process via conduit 27 and at least another portion is transported via conduit 28 and is admixed with a fresh make-up aqueous solution provided via conduit 25 and this resulting admixture is transported via conduit 29 and re-introduced via conduit 21 into vapor-liquid separator 22. A hydrocarbonaceous stream containing hydro-demetallized and hydrocracked hydrocarbons is removed from vapor-liquid separator 22 via conduit 23 and introduced into separation zone 19. A liquid stream containing hydrocarbon compounds is removed from vapor-liquid separator 17 via conduit 18 and introduced into separation zone 19. A gaseous vapor stream is removed from separation zone 19 via conduit 30 and recovered. A liquid stream containing hydrocarbonaceous compounds is removed from separation zone 19 via conduit 31 and at least a portion is removed from the process via conduit 32 and at least another portion is transported via conduit 33 and recycled as described hereinabove.

The process of the present invention is further demonstrated by the following illustrative embodiment. This illustrative embodiment is however not presented to unduly limit the process of this invention, but to further illustrate the advantages of the hereinabove-described embodiments. The following data were not completely obtained by the actual performance of the present invention, but are considered prospective and reasonably illustrative of the expected performance of the invention.

ILLUSTRATIVE EMBODIMENT

A stream of post-consumer waste plastic in an amount of 2025 mass units per hour (mu/hr) is introduced into the process and separated to produce a distillable lower boiling stream in an amount of 324 mu/hr and having a boiling range from about 350° to about 650° F., and a higher boiling stream in an amount of 1701 mu/hr and containing about 31 mu/hr of non-distillable solids. The higher boiling stream is admixed with a hydrocarbonaceous recycle stream in an amount of about 3278 mu/hr and having about 2000 mu/hr boiling in the range from about 3500 to 650° F. with the balance boiling at a temperature greater than about 650° F. The resulting admixture is filtered to remove essentially all of the solids and to provide a filtered higher boiling stream which is admixed with the distillable lower boiling stream. This resulting mixture of post-consumer waste plastic is introduced, together with about 154 mu/hr of a hydrogen-rich gaseous recycle stream, into a hydro-demetallization zone maintained at a pressure of about 950 psig and a temperature of about 650° F. The resulting effluent from the hydro-demetallization zone is introduced into a hydrocracking zone maintained at a pressure of about 900 psig and a temperature of about 725° F. The resulting effluent from the hydrocracking zone is introduced into a hot vapor-liquid separator maintained at about 500° F. and a pressure of about 850 psig. A vapor stream from the hot vapor-liquid separator in an amount of about 860 mu/hr is contacted with a circulating sodium carbonate solution in an amount of about 300 mu/hr, cooled and introduced into a cold vapor-liquid separator maintained at a temperature of about 100° F. and a pressure of about 850 psig. A resulting hydrogen-rich gaseous stream containing water-soluble inorganic compounds is contacted in the cold vapor-liquid separator with an aqueous stream in an amount of about 330 mu/hr to remove the water-soluble inorganic compounds and produce at least a portion of the hydrogen-rich gaseous recycle stream mentioned hereinabove. A fresh hydrogen make-up stream is also introduced in an amount of about 24 mu/hr. A spent aqueous solution is removed from the cold vapor-liquid separator and recovered. A hydrocarbon stream in an amount of about 709 mu/hr is removed from the cold vapor-liquid separator and introduced into a fractionation zone. A hydrocarbon stream in an amount of about 4535 mu/hr is removed from the hot vapor-liquid separator and introduced into the fractionation zone. A bottoms stream from the fractionation zone containing hydrocarbon compounds in an amount of about 3278 mu/hr is recycled as described hereinabove. A net combined liquid stream from both the top and bottom of the fractionation zone in an amount of about 1900 mu/hr is recovered as the synthetic crude oil product stream.

The foregoing description, drawing and illustrative embodiment clearly illustrate the advantages encompassed by the process of the present invention and the benefits to be afforded with the use thereof.

What is claimed:

1. A process for the conversion of plastic to produce a synthetic crude oil which process comprises:

(a) separating a liquefied stream of plastic to produce a distillable lower boiling stream and a higher boiling stream containing finely divided particulate matter;

(b) filtering said higher boiling stream containing finely divided particulate matter in admixture with a hydrocarbonaceous recycle stream to produce a filtered stream having a reduced concentration of finely divided particulate matter;

(c) contacting at least a portion of said distillable lower boiling stream from step (a), at least a portion of said filtered stream having a reduced concentration of finely divided particulate matter from step (b), and hydrogen with a hydro-demetallization catalyst in a hydro-demetallization zone operated at hydro-demetallization conditions;

(d) contacting the resulting hydrogen-hydrocarbon containing stream from step (c) with a hydrocracking catalyst in a hydrocracking zone operated at hydrocracking conditions to produce an effluent comprising lower boiling hydrocarbons and gaseous, water-soluble inorganic compounds;

(e) condensing at least a portion of the resulting effluent from said hydrocracking zone to produce a gaseous stream comprising hydrogen and said gaseous, water-soluble inorganic compounds, and a liquid stream comprising hydrocarbons;

(f) contacting said gaseous stream comprising hydrogen and said gaseous, water-soluble inorganic compounds with an aqueous solution to recover said gaseous, water-soluble inorganic compounds and to produce a hydrogen-rich gaseous stream;

(g) recycling at least a portion of the liquid stream comprising hydrocarbons to provide the hydrocarbonaceous recycle stream in step (b); and (h) recovering at least a portion of said liquid stream comprising hydrocarbons.

2. The process of claim 1 wherein at least a portion of said hydrogen-rich gaseous stream produced in step (f) is recycled to step (c).

3. The process of claim 1 wherein the weight ratio of said hydrocarbonaceous recycle stream to said higher boiling stream containing finely divided particulate matter is from about 1:1 to about 10:1.

4. The process of claim 1 wherein said filtering in step (b) is conducted in a back-flushed filter.

5. The process of claim 1 wherein said hydro-demetallization conditions include a temperature from about 400° F. to about 850° F., a pressure from about 100 psig (689 kPa gauge) to about 1800 psig, a liquid hourly space velocity from about 0.05 $hr^{-1}$ to about 20 $hr^{-1}$ and a hydrogen to feed ratio from about 200 standard cubic feet per barrel (SCFB) to about 50,000 SCFB.

6. The process of claim 1 wherein said hydrocracking conditions include a temperature from about 400° F. to about 850° F., a pressure from about 100 psig (689 kPa gauge) to about 1800 psig, a liquid hourly space velocity from about 0.05 $hr^{-1}$ to about 20 $hr^{-1}$ and a hydrogen to feed ratio from about 200 standard cubic feet per barrel (SCFB) to about 50,000 SCFB.

7. The process of claim 1 wherein said aqueous solution preferably contains a basic compound selected from the group consisting of sodium carbonate, calcium hydroxide, ammonium hydroxide, potassium hydroxide and sodium hydroxide.

8. The process of claim 1 wherein said separating in step (a) is conducted in a fractionation zone.

9. The process of claim 1 wherein said distillable lower boiling stream has an end boiling point in the range from about 150 to about 850° F.

10. The process of claim 1 wherein said higher boiling stream containing finely divided particulate matter has an end boiling point greater than about 850° F.

11. The process of claim 1 wherein said higher boiling stream containing finely divided particulate matter contains greater than about 50 weight percent non-distillable compounds.

12. The process of claim 1 wherein said filtering is conducted at conditions including a viscosity at operating temperature of less than about 10 centistokes.

13. The process of claim 1 wherein said plastic is selected from the group consisting of high density polyethylene, low density polyethylene, polystyrene, polyvinylchloride and PET.

14. The process of claim 1 wherein said plastic is post-consumer waste plastic.

* * * * *